United States Patent [19]

Darbowitch et al.

[11] Patent Number: 4,740,791

[45] Date of Patent: Apr. 26, 1988

[54] ANTENNA WITH PSEUDO-TORIC COVERAGE HAVING TWO REFLECTORS

[75] Inventors: Serge Darbowitch, Chatenay Malabry; Claude Aubry, Grigny, both of France

[73] Assignee: Thomson-CSF, Paris, France

[21] Appl. No.: 624,719

[22] Filed: Jun. 26, 1984

[30] Foreign Application Priority Data

Jul. 8, 1983 [FR] France ..... 83 11430

[51] Int. Cl.[4] ..... H01Q 3/12

[52] U.S. Cl. ..... 342/368; 343/757

[58] Field of Search ..... 343/761, 837, 781 P, 343/756, 872, 373, 757

[56] References Cited

U.S. PATENT DOCUMENTS

| | | | |
|---|---|---|---|
| 3,708,796 | 1/1973 | Gilbert | 343/756 X |
| 3,848,255 | 11/1974 | Migdal | 343/761 |
| 4,312,002 | 1/1982 | Stewart | 343/761 X |
| 4,424,500 | 1/1984 | Viola et al. | 343/373 X |
| 4,477,815 | 10/1984 | Brunner et al. | 343/872 X |

FOREIGN PATENT DOCUMENTS

| | | | |
|---|---|---|---|
| 1392013 | 2/1965 | France | 343/781 P |
| 1571407 | 6/1969 | France . | |
| 335425 | 2/1959 | Switzerland | 343/837 |

*Primary Examiner*—Theodore M. Blum
*Assistant Examiner*—Mark Hellner
*Attorney, Agent, or Firm*—Roland Plottel

[57] ABSTRACT

An antenna with pseudo-toric cover for transmitting and/or receiving a microwave, comprising principally an array transmitting a microwave towards a first reflector in the form of an elliptic or parabolic skull cap, whose concave side is turned towards the array and which reflects the energy towards a second reflector in the form of a concave ring, whose center is occupied by the array and whose concavity is turned towards said first reflector. The reflector is preferably supported by a radome.

9 Claims, 2 Drawing Sheets

FIG_3-a
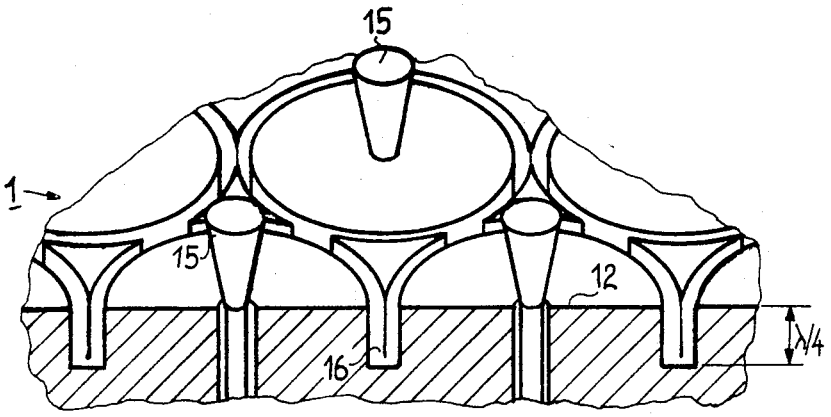
FIG_3-b
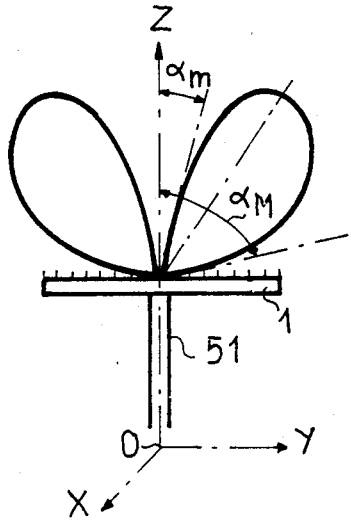
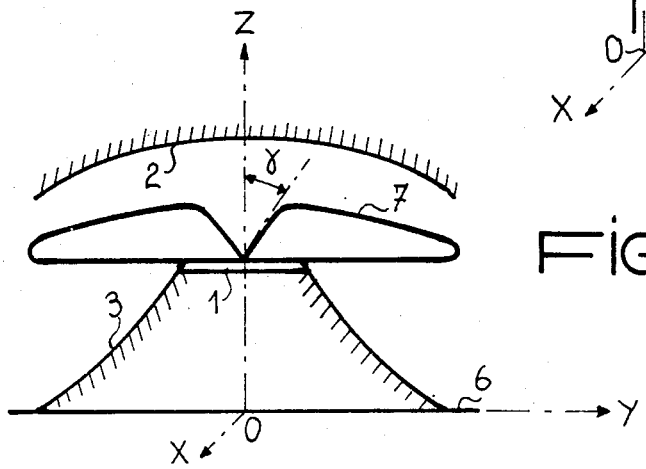
FIG_4

ANTENNA WITH PSEUDO-TORIC COVERAGE HAVING TWO REFLECTORS

BACKGROUND OF THE INVENTION

1. Field of the Invention

The present invention relates to an antenna with pseudo toric cover having two reflectors for transmitting and /or receiving microwaves.

2. Description of the Prior Art

Numerous radar applications require an antenna capable of providing rotating beams. It is known to obtain such rotating beams by means of rotating antennae; these have a number of well known disadvantages, particularly the lack of flexibility, which has leg to developing static antennae where the movement of the beam is provided electronically.

Different static antennae constructions are known, among which can be mentioned a structure formed of an assembly of antennae in the form of a slab, disposed in the shape of a truncated pyramid. The cover obtained is semi spherical and operation is satisfactory. Its drawback is however a high cost price . The so called dome antenna is also known which is formed by a network of radiating elements providing sweeping of the beam along a cone of limited angle, of the order of 90°, covered by a hemispherical dome, which comprises elements phase shifting the radiation passing therethrough, so that the sweep angle of the beam outside the dome is equal to 180°. The advantage of this structure is particularly to reduce the number of active elements required with respect to the preceding construction, but it has a certain number of drawbacks among which can be mentioned the complexity in manufacturing the dome including phase shifters, the volume of the resulting antenna and the losses occurring by reflection on the wall of the dome.

An object of the present invention is to provide a static antenna avoiding these disadvantages by using a double reflection system, the reflectors being passive and of revolution, which is relatively simple and inexpensive to manufacture.

SUMMARY OF THE INVENTION

According to the invention, there is provided an antenna with pseudo-toric cover for transmitting and/or receiving a microwave, admitting substantially of an axis of revolution and comprising: an array placed perpendicularly to said axis; a first reflector in the form of a skull cap whose concave side is turned towards said array ; a second reflector, in the form of a concave ring, extending on the other side of said array with respect to said first reflector, the center of said second reflector being occupied by said array, the meridian of said second reflector having its concavity turned towards said first reflector.

BRIEF DESCRIPTION OF THE DRAWINGS

Other objects, features and results of the invention will be clear from the following description, illustrated by the accompanying drawings in which:

FIG. 3*a* shows another embodiment of this array and FIG. 3*b* a radiation diagram relating thereto;

FIG. 4 shows the cover diagram of the antenna of the invention.

In these different Figures, the same references refer to the same elements.

DESCRIPTION OF THE PREFERRED EMBODIMENTS

Figure 1:
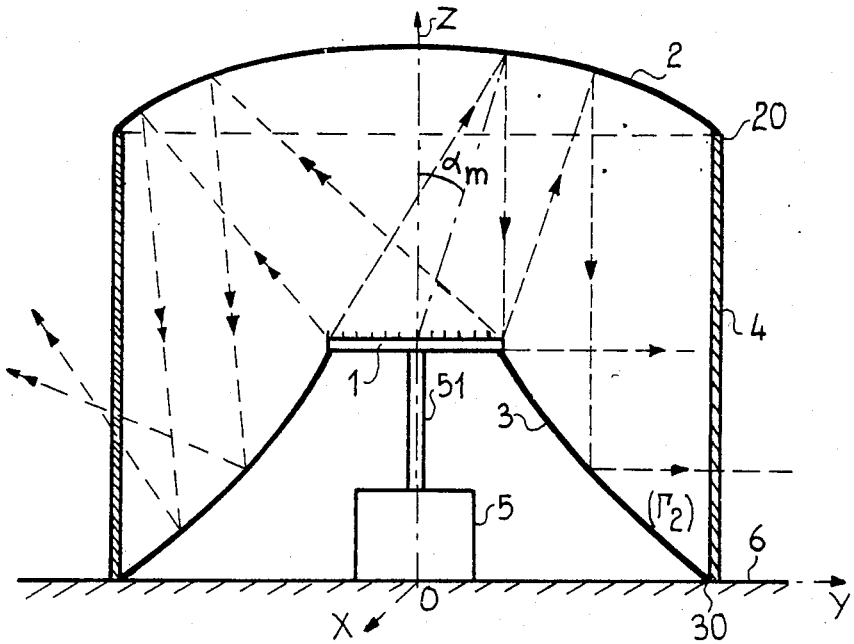
FIG. 1 shows one embodiment of the antenna in accordance with the invention.

In FIG. 1 one embodiment of the antenna of the invention has been shown. So as to simplify the explanations the operation of the antenna has been described for the case of transmission, it of course being understood that such an antenna is adapted not only for transmission but also for reception.

This antenna comprises means 1 for transmitting a microwave radiation, formed for example by a substantially flat array of radiating elements parallel to a plane XOY, for example horizontal, of revolution about an axis OZ normal to XOY. It receives the energy to be transmitted from means 5, placed for example on the array 1, on a flat surface 6 supporting the antenna for example also substantially parallel to XOY and transmitting to the array the microwave and controls required by means 51. Array 1 may be formed for example by a plurality of sources, fed by a network of circuits for forming one or more beams, shown in FIG. 1 as part of means 5; array 1 may also use phases shifters as illustrated below, these different devices forming means for the phase and possibly amplitude control of the law of illumination of the array.

The energy radiated by the array 1 is reflected by a reflector 2, substantially in the form of an elliptic or parabolic skull cap for example, whose concave side is turned towards array 1.

The radiation reflected by reflector 2 is reflected a second time by reflector 3 which is in the form of a ring surrounding array 1, this ring having a meridian whose concavity is turned towards reflector 2. Reflector 3 is also of revolution about axis OZ; it extends preferably as far as plane 6 supporting the antenna.

The antenna further comprises a radome 4 whose presence is not indispensable to its operation but which provides, apart from the conventional functions of a radome, a support for reflector 2. Randome 4 is substantially of revolution about the axis OZ just like reflector 2; it may be cylindrical or conical; it bears preferably on the one hand on the circumference 20 of reflector 2 and on the other on the outer circumference 30 of reflector 3.

Figure 2:
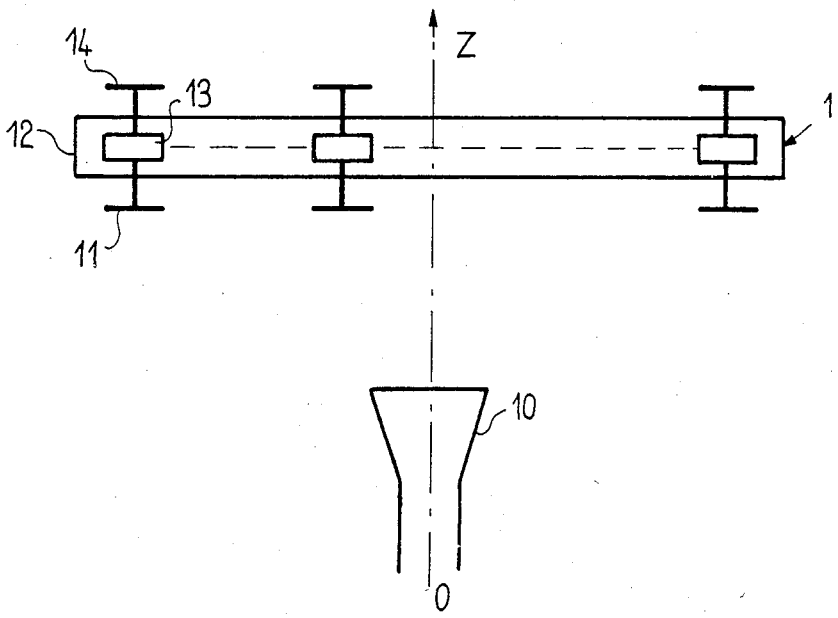
FIG. 2 shows one embodiment of a radiating array used in the antenna of the invention.

FIG. 2 shows an embodiment of array 1 of FIG. 1.

In this Figure, a disk shaped plate 12 can be seen with axis OZ, comprising radiating elements 11 and 14 respectively on both of its faces, for example of the dipole type. Each of elements 11 is connected to an element 14 by means of a phase shifter circuit 13. Array 1 thus formed is illuminated by a source or a system of primary microwave sources 10 with axis OZ.

As is well known the radiation transmitted by the system 10 is picked up by elements 11. After the phase shift induced by circuits 13, the radiation is retransmitted by the radiating elements 14. The angle of transmission of the energy by the assembly of radiating elements 14 is determined by the value of the phase shifts conferred by each of circuits 13 and by the characteristics of the system 10.

FIG. 3*a* shows a partial view of another embodiment of the array (1) used in the antenna of the invention, in which the radiating elements 14 of FIG. 2 are of the unipole type.

In FIG. 3*a*, a fraction of plate 12 has been shown seen in section in which are inserted radiating elements of the unipole type, reference 15, which are solids of revolution, for example as shown in the Figure with a conical form, which provides a greater bandwidth.

So as to reduce the coupling between the unipoles 15, in a variant of construction grooves 16 are disposed circularly about each unipole 15, these grooves forming traps for the microwave ; the depth of grooves 16 is of the order of a quarter of the wave length (λ) transmitted. As shown in the Figures, grooves 16 may be tangent circles.

In a preferred embodiment, unipoles 15 are disposed in staggered quincunx fashion.

By way of example, the height of the unipoles is of the order of λ/4, the angle at the top of the cone formed by a unipole may be of the order of 20° and the diameter of the circles formed by the grooves, of the order of λ/2.

In FIG. 3*b*, there is shown in polar coordinates the meridian section of the cover diagram (envelope of the possible radiation diagrams) obtained with an array 1 formed of unipoles such as illustrated in FIG. 3*a*.

It is apparent that the cover of such an array is pseudo-toric in form, i.e. whose directrix is a closed non circular curve, with a zero along the axis OZ and a zero in the plane XOY. The maximum opening angle is for example between 45° and 60°.

Referring to FIG. 1, it can be seen that such a diagram is particularly well adapted to the antenna of the invention, in which it is desirable to avoid any radiation within an angle $\alpha_m$ so that parasite and multiple reflections do not occur between array 1 and reflector 2.

The geometry adopted for reflectors 2 and 3 depends, from the characteristics of array 1, on the elevational cover law desired for the whole of the antenna, for example a cosecanted law. Such a law is shown by way of example in FIG. 4.

In this Figure, are shown supports for the antenna, its array 1 and its two reflectors 2 and 3. There is further shown by a curve 7 the law of cover of the antenna, which is pseudo-toric and limited practically, on the one hand, by a plane parallel to XOY and, on the other, by a cone with axis OZ and angle at the apex γ. It is apparent that the cover of the antenna of the invention is not hemispherical; however, this disadvantage is considered as being negligible, because the only targets which cannot be reached by such an antenna are those which are close to OZ, that is to say generally near the zenith, that is to say near-by targets.

Two methods of reflector calculation are possible. The first method, consists in considering the diagram of each source in presence of reflectors, in writing the expressions connecting together the energy densities at the level of array 1, of the first then of the second reflector, then in integrating the expressions obtained. Another method consists in breaking down the illuminations of the array and consequently the resulting diagrams, in the absence and in the presence of the reflectors, on a basis of orthogonal functions with circular symmetry. Calculation shows that there exists a multiplicity of possible solutions for the equations of the meridians of reflectors 2 and 3, the cover diagram desired for the antenna being previously fixed. A particular radiation diagram is then obtained by choosing the law for phase and possibly amplitude weighting of the array; that is of course an advantage. The final choice of the pair of meridians is made preferably by using the so called conformation technique known in the cassegrain type systems and which consists, after calculating the two reflectors, in modifying by successive approximations the meridian of one of them so as to approximate the desired radiation diagram, then modifying correspondingly the second reflector.

Referring to FIG. 1, element 4 may be a simple metal or dielectric support, continuous or not, of reflector 2. It may further support a polarization filter, formed of conducting wires parallel to the direction of the polarization to be eliminated. It may also support a polarizer for radiating for example a wave with circular polarization; in this case, it comprises conducting wires orientated at 45° with respect to the incident polarization. It may further form a mobile screen: it then comprises for example conducting wires parallel to each other, for example parallel to the direction OZ, each supporting in series diodes made conducting at will. In this example, it is possible to form a mobile screen: the screen part is then formed from an assembly of wires whose diodes are conducting, thus reflecting the energy whose polarization is parallel to them.

An antenna has been described above using passive focussers which allow the gain of the array to be modulated and thus the number of active elements required to be limited, for a given gain, with respect to direct radiation antennae. Moreover, this antenna uses the reflection phenomenon, thus avoiding the losses at the interfaces met with in transmission systems. Further more, it uses two reflectors, which confers a greater flexibility in the choice and focusing of the reflectors and limits the space occupied by the antenna. Moreover, the reflectors are passive and of revolution, which allows a relatively simple and inexpensive manufacture. Finally, this antenna is adapted to the radiation of any polarization: constant polarization in the whole diagram and parallel to OZ if the array is formed of unipoles, in plane XOY if the array is formed of current loops parallel to XOY, and circular if the array is formed for example of helixes or any other source of circular polarization.

The above described antenna is thus capable of transmitting and receiving a directional beam sweeping electronically the coverage zone of the antenna. It is also able to operate under multibeam conditions. In case of a multibeam antenna used solely for transmission, means 1 may be of any kind and may be formed for example by an omnidirectional source, with the reservation made above concerning the angle $\alpha_m$ (FIG. 1). When the multibeam antenna is used for reception, means 1 may be formed by an array, associated with a beam formation matrix (analog or digital) connected to an assembly of receivers. As is known when the beam formation matrix is digital, it must be placed upstream of the receivers. In the diagram of FIG. 1, the beam function matrix as well as the receivers are included in means 5.

The above description has been given by way of non limiting example. Thus, for example, axis OZ may be vertical, but this is in no wise necessary. Thus also array 1 has been described as being flat, but it may be slightly concave, with its concavity turned towards reflector 2 so as to facilitate focusing of the energy which it radiates on this reflector. Finally, the use of the unipole array such as described in FIG. 3 is not limited to an antenna such as described in FIG. 1, but extends to any type of antenna using an array.

What is claimed is:

1. A direction or an electronic sweep antenna with toroidal coverage for transmitting and/or receiving a microwave, said antenna having substantially an axis of revolution and comprising: an array (1) comprising a plurality of radiating elements for transmitting an electron scanning beam and/or receiving the microwave placed perpendicularly to said axis (OZ) and transmitting a coverage of toroidal shape (7, in FIG. 4) about said axis; a first fixed reflector (2) having one side in the form of a single concave surface, and whose concave side is turned towards and co-centered with said array; a second fixed reflector (3), in the form of a concave ring, extending on the other side of said array with respect to said first reflector, the center of said second reflector being occupied by said array, the meridian of said second reflector having its concavity turned towards said first reflector whereby said scanning toroidal shaped transmitted beam from said array is reflected from said first reflector to said second reflector and then outward from said antenna in a scanning toroidal coverage.

2. The antenna as claimed in claim 1, further comprising means for supporting said first reflector at its periphery.

3. The antenna as claimed in claim 2, wherein said support means further form a radome.

4. The antenna as claimed in claim 2 wherein said support means further form a plolarizer or a polarizing filter.

5. The antenna as claimed in claim 2 wherein said support means further form a mobile screen.

6. The antenna as claimed in claim 1, wherein said first reflector is substantially in the form of an elliptic or parabolic skull cap.

7. The antenna as claimed in claim 1, wherein said array comprises a plurality of radiating elements of the unipole type.

8. The antenna as claimed in claim 1, of the multibeam type, for receiving a microwave, further comprising a beam formation matric connected to a receiver assembly, associated to say array.

9. The antenna as claimed in claim 1 wherein said radiating elements are connected to phase shifters and said array comprises means for controlling said phase shifters.

* * * * *